United States Patent [19]

Misumi et al.

[11] Patent Number: 4,727,845

[45] Date of Patent: Mar. 1, 1988

[54] AIR-FUEL RATIO CONTROL APPARATUS FOR ENGINES

[75] Inventors: Masanori Misumi; Masashi Marubara; Makoto Hotate; Hiroyuki Oda, all of Hiroshima, Japan

[73] Assignee: Mazda Motor Corporation, Hiroshima, Japan

[21] Appl. No.: 42,505

[22] Filed: Apr. 27, 1987

[30] Foreign Application Priority Data

Apr. 28, 1986 [JP] Japan ..... 61-96913

[51] Int. Cl.[4] ..... F02D 41/14

[52] U.S. Cl. ..... 123/488; 123/480; 123/489

[58] Field of Search ..... 123/478, 480, 486, 488, 123/489

[56] References Cited

U.S. PATENT DOCUMENTS

| | | | |
|---|---|---|---|
| 4,311,042 | 1/1982 | Hosoya et al. | 123/478 |
| 4,528,961 | 7/1985 | Katoh et al. | 123/480 |
| 4,550,705 | 11/1985 | Nagano et al. | 123/480 |
| 4,561,403 | 12/1985 | Oyama et al. | 123/489 |

*Primary Examiner*—Andrew M. Dolinar

*Attorney, Agent, or Firm*—Wegner & Bretschneider

[57] ABSTRACT

The air-fuel ratio of an air-fuel mixture supplied to an internal combustion engine is determined on the basis of a smoothed amount of intake air and a smoothed throttle opening. The smoothed amount of intake air is reflected by a predetermined ratio of a former amount of intake air to the newest amount of intake air. The smoothed throttle opening is reflected by a ratio of a former throttle opening to the newest throttle opening substantially identical to said predetermined ratio.

12 Claims, 7 Drawing Figures

FIG. 3

(AF 1) ms

| Ne \ Tpk 4 | 0.5 | 1.0 | 1.5 | 2.0 | 2.5 | 3.0 | 3.5 | 4.0 | 4.5 | 5.0 | 5.5 | 6.0 | 6.5 |
|---|---|---|---|---|---|---|---|---|---|---|---|---|---|
| 4 | 16 | 16 | 16 | 16 | 16 | 16 | 16 | 16 | 16 | 16 | 14 | 14 | 14 |
| 6 | | | | | | | | | | | | | |
| 8 | | | 18 | 18 | 18 | 18 | 18 | 18 | 18 | 18 | 18 | | |
| 10 | | | 20 | 20 | 20 | 20 | 20 | 20 | 20 | 20 | 20 | | |
| 12 | | | | | | | | | | | | | |
| 14 | | | | | | | | | | | | | |
| 16 | | | | | | | | | | | | | |
| 18 | | | | | | | | | | | | | |
| 20 | | | | | | | | | | | | | |
| 22 | | | | | | | | | | | | | |
| 24 | | | | | | | | | | | | | |
| 28 | | | | | | | | | | | | | |
| 32 | | | | | | | | | | | | | |
| 36 | | | | | | | | | | | | | |
| 40 | | | 14 | 14 | 14 | 14 | 14 | 14 | 14 | 14 | 14 | | |
| 48 | | | | | | | | | | | | | |
| 56 | | | | | | | | | | | | | |
| 64 | | | | | | | | | | | | | |

x 1000 rpm

FIG. 4

(AF 2) %

| Ne \ $T_{A4}$ | 0 | 8.3 | 16.7 | 20.8 | 25.0 | 29.2 | 33.3 | 37.5 | 41.7 | 45.8 | 50.0 | 75.0 | 100 |
|---|---|---|---|---|---|---|---|---|---|---|---|---|---|
| 4 | 0 | 0 | 0 | 0 | 0.2 | 0.3 | 0.4 | 0.5 | 0.6 | 0.7 | 0.8 | 1 | 1 |
| 6 | | | | | | | | | | | | | |
| 8 | | | | | | | | | | | | | |
| 10 | | | | | 1 | 2 | 3 | 3.5 | 4 | 4.5 | 5 | | |
| 12 | | | | | | | | | | | | | |
| 14 | | | | | | | | | | | | | |
| 16 | | | | | | | | | | | | | |
| 18 | | | | | | | | | | | | | |
| 20 | | | | | | | | | | | | | |
| 22 | | | | 1 | 2 | 3 | 4 | 5 | 5 | 4 | 3 | | |
| 24 | | | | 2 | 3 | 4 | 5 | | | | | | |
| 28 | | | | | | | | | 4 | | | | |
| 32 | | | | 3 | 4 | 5 | | 4 | | | 2 | | |
| 36 | | | | 5 | 5 | 6 | 6 | | 3 | 2 | | | |
| 40 | | 1 | 1 | 1 | 1 | 1 | 1 | 1 | 1 | | | | |
| 48 | | | | | | | | | | | | | |
| 56 | | | | | | | | | | | | | |
| 64 | | | | | | | | | | | | | |

x 1000 rpm

AIR-FUEL RATIO CONTROL APPARATUS FOR ENGINES

FIELD OF THE INVENTION

The present invention relates to an air-fuel ratio control apparatus for engines adapted to determine a target air-fuel ratio by an amount of intake air and a degree of a throttle opening.

BACKGROUND OF THE INVENTION

In an engine that is constructed so as to change air-fuel ratios of an air-fuel mixture supplied thereto in accordance with operation states of the engine, it is a general practice to determine a target air-fuel ratio on the basis of an amount of intake air. A sensor to be used here for the purpose to detect amounts of intake air is likely to cause the hunting or the overshoot. In particular, a sensor of a flap type, which is equipped with a flap portion designed to be displaced by a flow of intake air, has a remarkable tendency to cause such phenomena. Accordingly, an intake air amount detecting sensor as intake air amount detecting means for detecting amounts of intake air is designed so as to subject outputs therefrom to a sort of smoothing treatment, thereby causing a sensitivity of the sensor to be substantially decreased. The smoothing treatment referred to here is to obtain an artificial amount of intake air on the basis of a current amount of intake air detected by the sensor and a past amount of intake air stored in advance in memory means and then determine a target air-fuel ratio on the basis of the artificial amount of intake air. This treatment serves as a prevention from adverse influences caused by the hunting or the like.

There is also a growing tendency that an engine uses the feedback control of an air-fuel ratio of the air-fuel mixture based on an air-fuel ratio of exhaust gases in order to achieve an accurate control of air-fuel ratios for an internal combustion engine. Japanese Patent Early Publication No. 32,946/1983 discloses a so-called "lean sensor" as an air-fuel ratio sensor for detecting air-fuel ratios of exhaust gases, which is designed to give outputs corresponding to air-fuel ratios of exhaust gases, thereby leading to a leaner air-fuel ratio of the air-fuel mixture, say, a larger air-fuel ratio.

It is to be understood that an amount of intake air corresponds eventually to an engine load, say, a throttle opening, and that a variation in amounts of intake air becomes larger with respect to a variation in the throttle openings when the throttle opening is still small, while a variation in amounts of intake air becomes smaller with respect thereto when the throttle opening gets larger. Accordingly, if a target air-fuel ratio is determined by dependence only upon the amounts of intake air, it becomes difficult to make an accurate detection of amounts of intake air particularly in operation states in which amounts of intake air get larger. In order to overcome the drawbacks encountered in the prior art, U.S. patent application Ser. No. 813,933, now U.S. Pat. No. 4,662,339, corresponding to Japanese Patent Early Publication No. 167,134/1986 proposes the determination of a target air-fuel ratio for an engine using a throttle opening as well as an amount of intake air. This permits the determination of the target air-fuel ratio by obtaining a first target air-fuel ratio based on the amount of intake air and a second target air-fuel ratio based on the throttle opening and then by determining a final target air-fuel ratio based on the both first and second target air-fuel ratios. In this case, it may also be considered that the amount of intake air is corrected by the throttle opening.

As have been described above, the determination of the final target air-fuel ratio on the basis of the amount of intake air and the throttle opening permits a stabilization of air-fuel artios during the constant operation as well as a highly accurate determination of air-fuel ratios. It has been found, however, that this may be encountered with a problem that a final target air-fuel ratio is caused to be deviated to a large extent during the transition period when driving states of an engine are changed. It was found that this deviation was caused by the fact that there was a difference between a response to the detection of the throttle opening and a response to the detection of the amount intake air. A delay in the response to the detection of the amount of intake air with respect to the response to the detection of the throttle opening is caused to occur because the amount of intake air has heretofore been subjected to the smoothing treatment for a prevention from the hunting or the like.

SUMMARY OF THE INVENTION

The present invention has the object to provide an air-fuel ratio control apparatus for engines adapted to be capable of preventing a target air-fuel ratio during the transit engine operation from being deviated, using a target air-fuel ratio determined on the basis of an amount of intake air and a throttle opening.

In order to achieve the above object, the present invention is arranged such that, like an amount of intake air, a throttle opening is also subjected to the smoothing treatment to determine a target air-fuel ratio.

The air-fuel ratio control apparatus according to the present invention comprises as shown in FIG. 6, intake air amount detecting means for detecting an amount of intake air supplied to the engine and providing a signal corresponding to said amount of intake air; intake air amount memorizing means for memorizing the amount of intake air detected by said intake air amount detecting means; throttle opening detecting means for detecting an opening degree of a throttle valve mounted in an intake passage of the engine and providing a signal corresponding to the throttle opening; throttle opening memorizing means for memorizing the throttle opening detected by said throttle opening detecting means; intake air amount determining means for determining a smoothed amount of intake air so as to reflect a predetermined ratio of a former amount of intake air memorized in said intake air amount memorizing means to a current amount of intake air corresponding to an output from said intake air detecting means; throttle opening determining means for determining a smoothed throttle opening so as to reflect a ratio of a former throttle opening memorized in said throttle opening memorizing means to a current throttle opening at said predetermined ratio; air-fuel ratio determining means for the air-fuel ratio of an air-fuel mixture supplied to the engine on the basis of the respective outputs from said intake air amount determining means and said throttle opening determining means; and air-fuel ratio adjusting means for adjusting an air-fuel ratio of the air-fuel mixture supplied to the engine so as to become the air-fuel ratio determined by said air-fuel ratio determining means.

With this arrangement, the present invention permits the highly accurate detection of an amount of intake air without being adversely affected by the hunting or the like caused by the smoothing treatment of the intake air amount. At the same time, the present invention can prevent a large deviation in a target air-fuel ratio from being caused to occur during the engine operation in transition even if a target air-fuel ratio is determined by the amount of intake air and the throttle opening because the throttle opening detected is also subjected to the smoothing treatment to cause a delay in response, as for the amount of intake air, in consideration of a delay in response accompanied with the smoothing treatment of the amount of intake air.

It is to be noted that a former value to be used for the smoothing treatment of each of the amount of intake air and the throttle opening may be the last one, the before-last one, the one previous to the before-last or other previous ones. It is further noted that memory means may memorize directry values detected by detecting means or smoothed values thereof.

BRIEF DESCRIPTION OF THE DRAWINGS

FIGS. 3 and 4 are each a table illustrating an example of a map for obtaining a target air-fuel ratio.

DETAILED DESCRIPTION OF PREFERRED EMBODIMENTS

Figure 1:
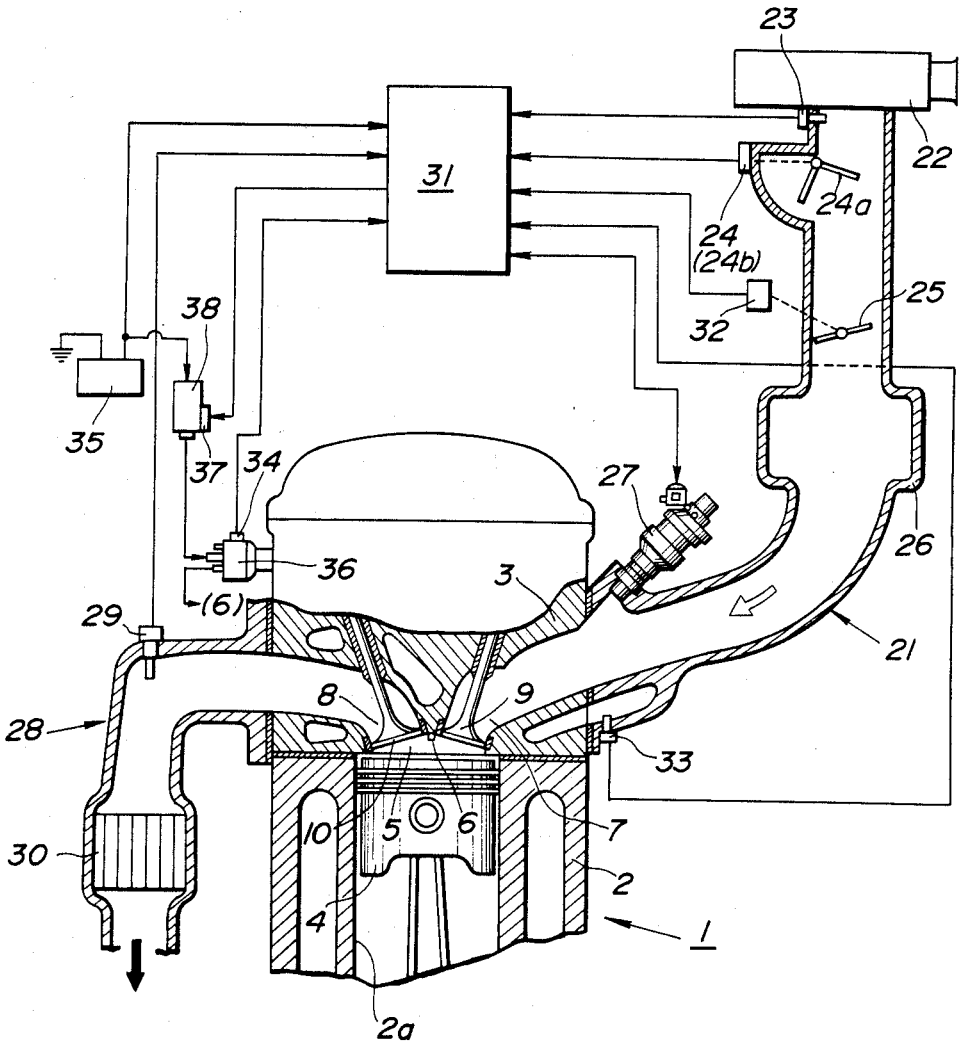
FIG. 1 is a schematic diagram showing the construction of an embodiment according to the present invention.

Referring to FIG. 1, reference numeral 1 denotes an Otto engine of a 4-cycle reciprocating type, which contains a cylinder block 2, a cylinder head 3, a piston 4 inserted in a cylinder 2*a*, and a combustion chamber 5 that is provided with a spark plug 6 and opening for an intake port 7 and an exhaust port 8. The opening for the intake port 7 is constructed to be opened or closed by an intake valve 9 in synchronization with an engine output shaft at known timings. An exhaust valve 10 is constructed so as to be synchronize with the engine output shaft at known timings for opening or closing the opening for the exhaust port 8.

An intake passage 21 communicating with the intake port 7 is provided with an air cleaner 22, an intake air temperature sensor 23 for detecting temperatures of intake air, an air flowmeter 24 for detecting amounts of intake air, a throttle value 25, a surge tank 26, and a fuel injection valve 27 in this order from the upstream side to the downstream side. The air flowmeter 24 may be of the flap type having a flap portion 24*a* mounted pivotably in the intake passage 21. The flap portion 24*a* is constructed so as to be desplaced by pressures applied by a flow of intake air to a pivoted position in accordance with an amount of intake air, and the pivoted position is designed to be detected, for example, with a potentiometer 24*b*. The fuel injection valve 27 is of the known electromagnetic type capable of adjusting amounts of fuel to be injected by adjusting a period of time for opening the valve. More specifically, the fuel injection valve 27 is described to permit a control of amounts of fuel injection therefrom by changing the width of a drive pulse for the fuel injection valve 27 (for example, by way of the Duty control).

An exhaust passage 28 communicating with the exhaust port 8 is provided with an air-fuel ratio sensor 29 at the upstream side and a ternary catalyzer 30 as an apparatus for cleaning exhaust gases at the downstream side. The air-fuel sensor 29 is generally called as a so-called "lean sensor", which is designed to output signals in accordance with ratios of air to fuel in exhaust gases. There is commercially available one that permits an output of signals in virtually proportion to air-fuel ratios.

As shown in FIG. 1, reference numeral 31 denotes a control unit composed of a microcomputer containing mainly a CPU, a RAM, a ROM, and a CLOCK. Into the control unit 31, there are input signals from the intake air temperature sensor 23, the air flowmeter 24 and the air-fuel ratio sensor 29 and from sensors 32, 33 and 34. Voltage signals from a battery 35 are also input into the control unit 31. The sensor 32 is to detect an opening degree of the throttle valve 25, say, an engine load. The sensor 33 is to detect temperatures of water for cooling the engine. The sensor 34 that is mounted on a distributer 36 is to detect cranking angles, that is, the number of revolutions of the engine. The control unit 31 provides signals to the fuel injection valve 27 and an igniter 37. When an ignition signal is given from the control unit 31 to the igniter 37 at an predetermined ignition timing, primary electric currents in an ignition coil 38 are blocked to generate high voltage at the secondary side, and the high voltage generated is then supplied to the spark plug 6 through the distributer 36.

Figure 2A:
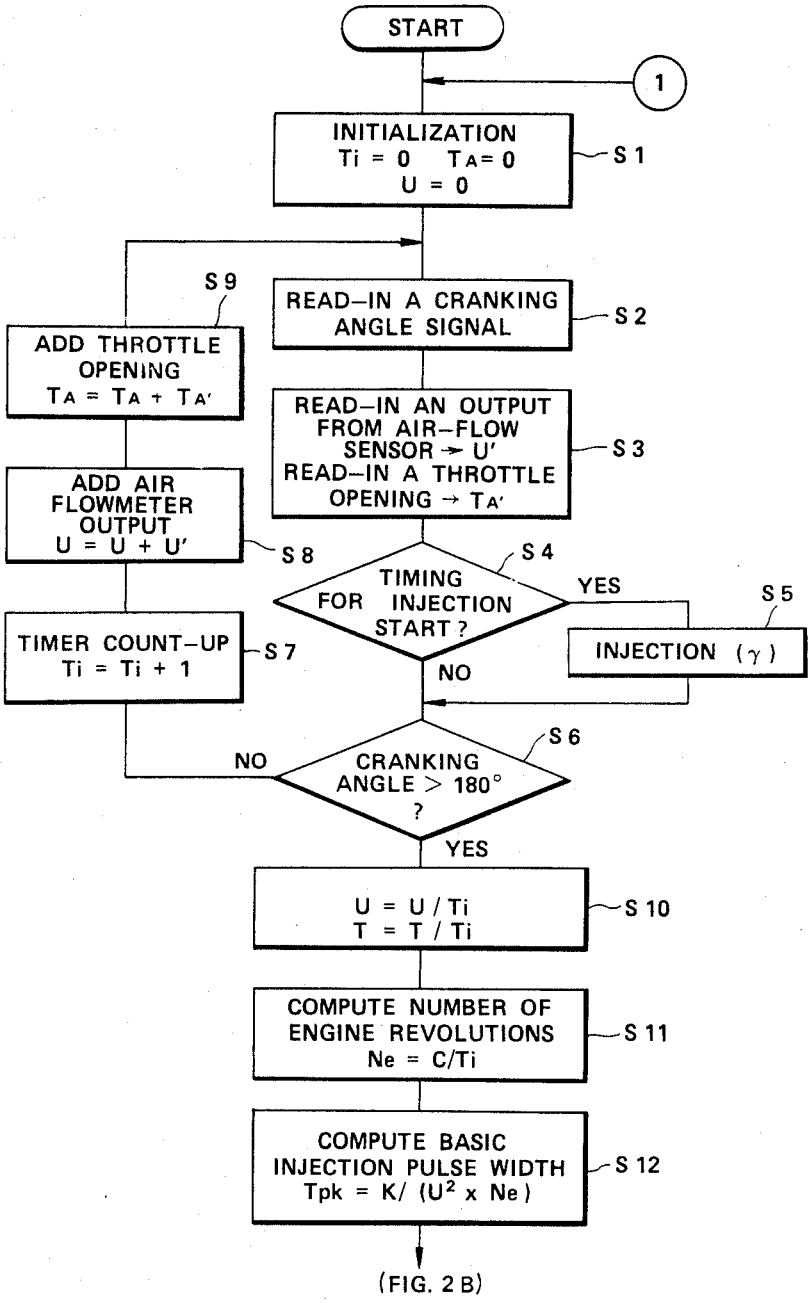
FIGS. 2*a* and 2*b* are each a flowchart illustrating an example of the control according to the present invention.
Figure 2B:
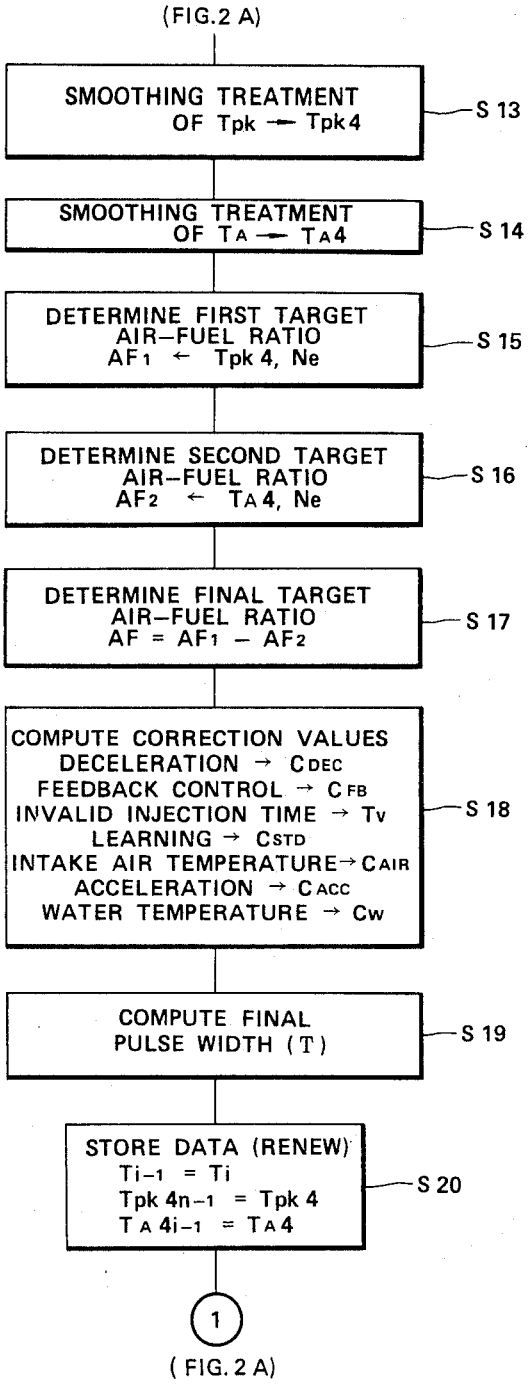

The air-fuel ratio control to be conducted by the control unit 31 will be described more in detail with reference to the flowchart illustrated in FIG. 2. In the following description, reference symbol "S" is an abbreviation of the word "step".

In S1, a count valve Ti of a timer, an integrated value $T_A$ of a degree of the throttle opening, and an integrated value U of an amount of intake air, as will be each described below, are initialized each to zero. Thereafter, in S2, a signal from a cranking angle sensor, say, a position of a current cranking angle is read in and, in S3, an output from an air flow sensor (an amount of intake air) U' and a current throttle opening $T_A'$ are each read in.

In S4, it is distinguished whether or not the current cranking angle position is a right timing for the fuel injection. If YES in S4, an amount of fuel corresponding to an injection amount $\tau$ set as will be described below is injected from the fuel injection valve 27 in S5, and the flow proceeds to S6. If NO in S4, the flow advances directly to S6 without passing through S5.

In S6, it is distinguished whether or not the position of the current cranking angle passes 180°, say, the position of the bottom dead center. If NO in S6, the flow proceeds to S7 and the count value Ti of the timer is counted up to Ti+1, then, in S8, an output from the air flow sensor (an amount of intake air) U is integrated to U+U' and, in S9, the throttle opening $T_A$ is integrated to $T_A+T_A'$. The time Ti required for these integrations is also computed.

If YES in S6, the current amount of intake air U and the current throttle opening $T_A$ are set in S10, respectively, by dividing the valve U integrated in S8 and the value $T_A$ integrated in S9 by the count value Ti counted in S7. Then, in S11, the number of engine revolutions Ne is computed by dividing a predetermined constant C by the count value Ti.

In S12, a basic injection pulse width $T_{PK}$ is computed on the basis of the amount of intake air U computed in S10 by the following equation:

$$T_{PK}=K/(U^2+Ne)$$

where K is a constant. The basic injection pulse width $T_{PK}$ computed in S12 is to correspond to the stoichiometric air-fuel ratio (14:7). The equation itself is chracterized by the fact that it is determined by an output characteristic of the air flowmeter 24.

In S13, an artificial injection pulse width of the basic injection pulse width $T_{PK}$ computed in S12, say, a smoothed value $T_{PK4}$, is computed. The computation of the smoothed value $T_{PK4}$ is carried out on the basis of the current basic injection pulse width $T_{PK}$ and the last smoothed value $T_{PK4n-1}$ memorized immediately before the current one by the following equation:

$$T_{PK4}=(3\times T_{PK4n-1}+T_{PK})/4$$

In this embodiment, as is apparent from the above equation, the ratio of the smoothed value $T_{PK4n-1}$ to the current basic injection pulse width $T_{PK}$ is 3:1. It is to be noted that the smoothing treatment of the basic injection pulse width $T_{PK}$ is substantially the same as the smoothing treatment of the amounts of intake air, say, the determination of an artificial amount of intake air, because the basic injection pulse width $T_{PK}$ is based on the amounts of intake air U, as is apparent from S12. Thus, the smoothed value $T_{PK4}$ is sometimes referred to in the following description so as to represent an artificial amount of intake air. Likewise, in S14, the smoothing treatment of the throttle opening $T_A$ is conducted to give an artificial throttle opening $T_{A4}$ by the following equation:

$$T_{A4}=(3\times T_{A4i-1}+T_A)/4$$

As is apparent from this equation, a ratio of the former throttle opening $T_{A4i-1}$ to the current throttle opening $T_A$ (the value $T_A$ in S10) is 3:1, too, as for the ratio of the smoothed value $T_{PK4n-1}$ to the basic injection pulse width $T_{PK}$.

In S15, a first target air-fuel ratio AF1 is read in from Map 1 prepared in advance as illustrated in FIG. 3, using as parameters the number of engine revolutions Ne, taken on the axis of abscissa, and the artificial intake air amount $T_{PK4}$ computed in S13, taken on the axis of ordinate. In S16, a second target air-fuel ratio AF2 is read in from Map 2 prepared in advance as illustrated in FIG. 4, using as parameters the number of engine revolutions Ne, taken on the axis of abscissa, and the artificial throttle opening $TA_4$ computed in S14, taken on the axis of ordinate. Then, in S17, a final target air-fuel ratio AF is determined by subtracting the second target air-fuel ratio AF2 from the first target air-fuel ratio AF1. In FIGS. 3 and 4, it should be understood that each of blank square spaces is shown to refer to the number illustrated just before on the same column of the map. For example, in FIG. 3, where $T_{PK4}$ is 1.0 ms and Ne is 20×1,000 r.p.m., the corresponding square space in blank should be read as AF1 being 16.

Then, in S18, various correction values are computed. An invalied injection time Tv is determined on the basis of a battery voltage. A feedback correction value $C_{FB}$ is obtained, as being known to the skilled in the art, by a giving a slice level in accordance with the final target air-fuel ratio AF and an output value from the air-fuel ratio sensor 29 to a comparater and then by adjusting the output from the comparater by way of the P (proportion) control and the I (integration) control. A learning value $C_{STD}$ is obtained by way of the smoothing treatment for giving the feedback constant $C_{FB}$. After these correction values are computed, a final injection pulse width $\tau$ is computed in S19 usung each of the correction values computed in S18, according to the following formula:

$$T_{PK}\times C_{AIR}\times\frac{14.7}{AF\times Cw}\times(1+C_{FB}+C_{STD}+C_{ACC}+C_{DEC})+T_v$$

where $C_{AIR}$ represents a correction value for a temperature of intake air, Cw presents a correction value for a temperature of cooling water, $C_{ACC}$ represents a correction value for acceleration, and $C_{DEC}$ represents a correction value for deceleration.

Then, in S20, the data obtained above are atored and renewed in a memory. In S20, the latest artificial basic injection pulse width $T_{PK4}$ computed in S13 and the latest artificial throttle opening $T_A$ are stored and renewed in a memory, respectively, so as to bė used as $T_{PK4n-1}$ for computing $T_{PK4}$ in the coming S13 and as $T_{A41-1}$ for computing $T_{A4}$ in the coming S14.

Figure 5:
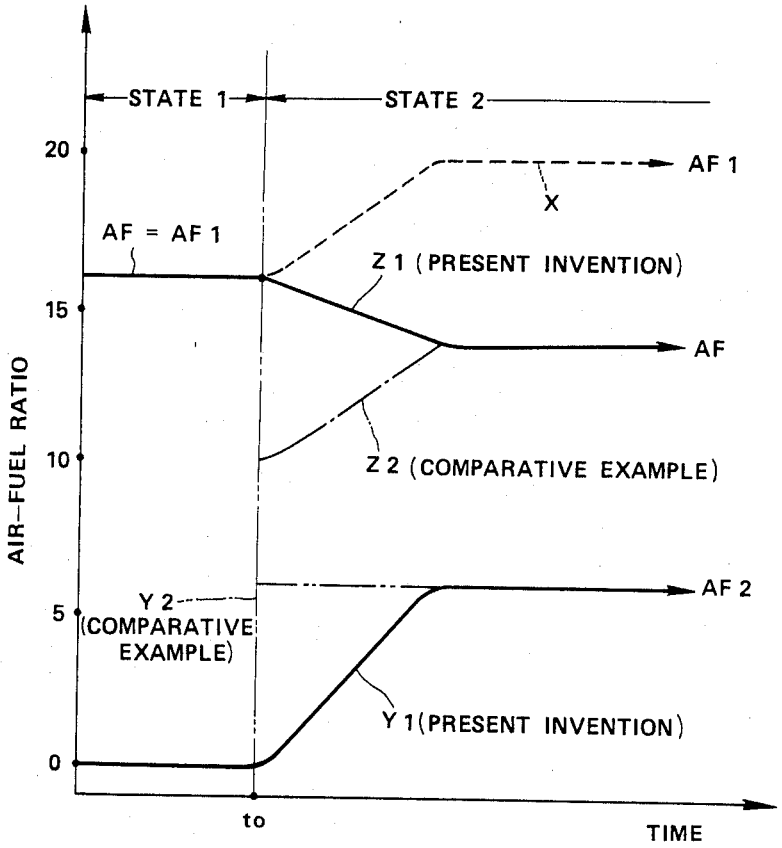
FIG. 5 is a graph illustrating patterns of a variation in air-fuel rations by the control according to the present invention.
Figure 6:
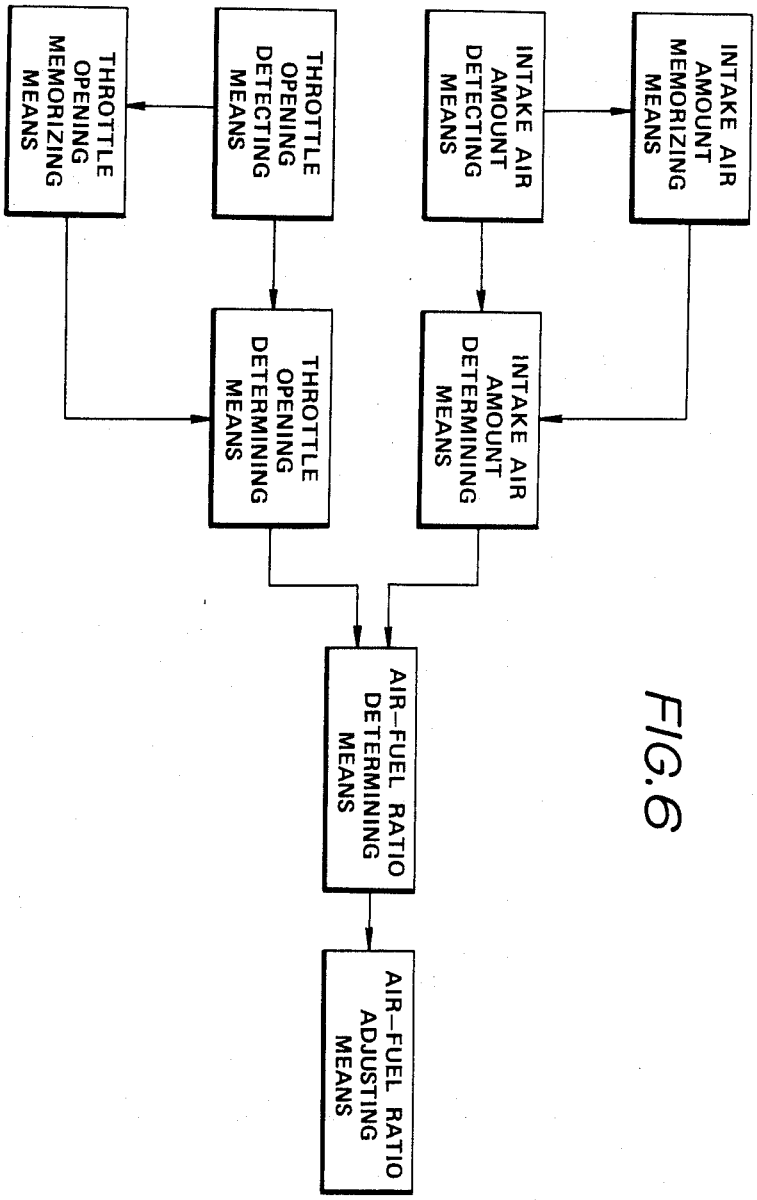
FIG. 6 is a block diagram illustrating the function of the present invention.

As have been described above, the air-fuel ratios (final target air-fuel ratios) are controlled. FIG. 5 shows an example illustrating a pattern of a variation in air-fuel ratios by the control in accordance with the present invention. In FIG. 5, there is shown a variation of air-fuel ratios in two separate states. The states are separated from each other into State 1 and State 2 with the boundary drawn on the time $t_0$. In the State 1, the air-fuel ratio is in a stable state at Af-16, where AF, is 16 and AF2 is 0. And in the State 2, the air-fuel ratio is changed, for example, to AF=14 at AF1=20 and AF2=6. As is apparent from FIG. 5, the first target air-fuel ratio AF1 is caused to be changed gradually from 16 to 20 by the smoothing treatment, say, determination on the basis of the artificial amount of intake air $T_{PK4}$, as shown by the line X, while the second target air-fuel ratio AF2 is caused to be changed gradually from 0 to 6 by the smoothing treatment, like the smoothing treatment of the first target air-fuel ratio AF1, say, determination on the basis of the artificial throttle opening $T_{A4}$, as shown by the line Y1. As a result, the final target air-fuel ratio AF is likewise caused to be changed gradually from 16 to 14, thereby preventing the final target air-fuel ratio AF from being deviated to a large extent, as shown by the line Z1.

On the other hand, if the second target air-fuel ratio AF2 is obtained on the basis of the current throttle opening $T_A$, not the artificial throttle opening $T_{A4}$, the second target air-fuel ratio AF2 is caused to be changed rapidly from 0 to 6, as shown by the line Y2 in FIG. 5, whereby the final target air-fuel ratio AF is caused to be changed once in the rich region to a large extent after the time $t_0$, as shown by the line Z2 in FIG. 5.

It is here to be understood that the feedback control of the air-fuel ratio may be conducted only during the operation in the stoichiometric air-fuel ratio. In this case, as the air-fuel ratio sensor 29, there may be used one that is operative in an ON/OFF manner with the stoichiometric air-fuel ratio as the boubdary. It is also to be understood that the control of the air-fuel ratio may be carried out by the open control. It is a matter of course that the control unit 31, when being composed of a microcomputer, is of the digital type or of the analog type.

Although the present invention is described with reference to the preferred embodiments thereof, it is to be understood that any and all variations and modifications that do not depart from the spirit and scope of the appended claims should be interpreted as being encompassed within the scope of the present invention.

What is claimed is:

1. An air-fuel ratio control apparatus for an engine comprising:

intake air amount detecting means for detecting an amount of intake air supplied to the engine and providing a signal corresponding to said amount of intake air;

intake air amount memorizing means for memorizing the amount of intake air detected by said intake air amount detecting means;

throttle opening detecting means for detecting an opening degree of a throttle valve mounted in an intake passage of the engine and providing a signal corresponding to the throttle opening;

throttle opening memorizing means for memorizing the throttle opening detected by said throttle opening detecting means;

intake air amount determining means for determining a smoothed amount of intake air so as to reflect a predetermined ratio of a former amount of intake air memorized in said intake air amount memorizing means to a current amount of intake air corresponding to an output from said intake air detecting means;

throttle opening determining means for determining a smoothed throttle opening so as to reflect a ratio of a former throttle opening memorized in said throttle opening memorizing means to a current throttle opening at said predetermined ratio;

air-fuel ratio determining means for the air-fuel ratio of an air-fuel mixture supplied to the engine on the basis of the respective outputs from said intake air amount determining means and said throttle opening determining means; and air-fuel ratio adjusting means for adjusting an air-fuel ratio of the air-fuel mixture supplied to the engine so as to become the air-fuel ratio determined by said air-fuel ratio determining means.

2. The air-fuel ratio control apparatus according to claim 1, wherein said intake air amount detecting means has a flap portion equipped in said intake passage in such a manner as capable of being displaced by a flow of intake air.

3. The air-fuel ratio control apparatus according to claim 1, wherein each of said memorizing means is to memorize a value just previous to the one detected by the respective detecting means as the former value; and said intake air amount determining means and said throttle opening determining means are each to set a value obtained by adding said value just previous thereto, memorized by said respective memorizing means, multiplied by n to the newest value and then dividing the resulting product by $(n+1)$.

4. The air-fuel ratio control apparatus according to claim 1, wherein said air-fuel ratio determining means contains:

first target air-fuel ratio determining means for determining a first target air-fuel ratio on the basis of an output from said intake air amount determining means;

second target air-fuel ratio determining means for determining a second target air-fuel ratio on the basis of an output from said throttle opening determining means; and final target air-fuel ratio determining means for determining a final target air-fuel ratio on the basis of the respective outputs from said first and second air-fuel ratio determining means.

5. The air-fuel ratio control apparatus according to claim 4, wherein said first air-fuel ratio determining means comprises memorizing means in which the value determined by said intake air amount determining means is memorized by corresponding to said first air-fuel ratio; and said second air-fuel ratio determining means comprises memorizing means in which the value determined by said throttle opening determining means is memorized by corresponding to said second air-fuel ratio.

6. The air-fuel ratio control apparatus according to claim 1, wherein said engine is of the fuel injection type.

7. An air-fuel ratio control apparatus comprising:

intake air amount detecting means for detecting an amount of intake air of the engine and providing a signal corresponding to the amount of intake air;

intake air amount memorizing means for memorizing the amount of intake air detected by said intake air amount detecting means;

throttle opening detecting means for detecting an opening degree of a throttle valve mounted in an intake passage and providing a signal corresponding to the opening degree of the throttle valve;

throttle opening memorizing means for memorizing the throttle opening detected by said throttle opening detecting means;

intake air amount determining means for determining a smoothed amount of intake air so as to reflect a predetermined ratio of a former amount of intake air memorized in said intake air amount memorizing means to accurent amount of intake air corresponding to an output from said intake air detecting means;

throttle opening determining means for determining a smoothed throttle opening so as to reflect a ratio of a former throttle opening memorized in said throttle opening memorizing means to a current throttle opening at said predetermined ratio;

a fuel injection valve mounted in said intake passage;

basic injection amount determining means for determining a basic fuel injection amount in the basis of an output from said intake air amount detecting means;

air-fuel ratio determining means for determining the air-fuel ratio of a air-fuel mixture supplied to the engine on the basis of the respective outputs from said intake air amount determining means and said throttle opening determining means; and final injection amount determining means for determining a final fuel injection amount by correcting the basic fuel injection amount on the basis of the air-fuel ratio determined by said air-fuel ratio determining means in response to the respective outputs from said basic injection amount determining means and said air-fuel ratio determining means.

8. The air-fuel ratio control apparatus according to claim 7, wherein said fuel injection value is of the electromagnetic type; and each of said basic injection amount determining means and said final injection amount determining means is to determine the pulse width of a driving pulse to be given to said fuel injection valve.

9. The air-fuel ratio control apparatus according to claim 7, wherein said intake air amount detecting means has a flap portion equipped in said intake passage in such a manner as capable of being displaced by a flow of intake air.

10. The air-fuel ratio control apparatus according to claim 7, wherein said air-fuel ratio determining means contains;

first target air-fuel ratio determining means for determining a first target air-fuel ratio on the basis of an output from said intake air amount determining means;

second target air-fuel ratio determining means for determining a second target air-fuel ratio on the basis of an output from said throttle opening determining means; and final target air-fuel ratio determining means for determining a final target air-fuel ratio on the basis of the respective outputs from said first and second air-fuel ratio determining means.

11. The air-fuel ratio control apparatus according to claim 7, wherein said basic fuel injection amount is set as a value corresponding to the stoichiometoric air-fuel ratio; and said air-fuel ratio determining means is to output a signal representative of a degree of the air-fuel ratio itself.

12. The air-fuel ratio control apparatus according to claim 11, wherein said final injection amount determining means is to correct the basic fuel injection amount corresponding to the stoichiometric air-fuel ratio by a ratio of the stoichiometric air-fuel ratio to an output value of said air-fuel ratio determining means.

* * * * *